US005240444A

United States Patent [19]

Kobayashi et al.

[11] Patent Number: 5,240,444

[45] Date of Patent: Aug. 31, 1993

[54] WATER JET PROPULSION BOAT

[75] Inventors: Noboru Kobayashi; Hirofumi Imaeda, both of Iwata, Japan

[73] Assignee: Yamaha Hatsudoki Kabushiki Kaisha, Iwata, Japan

[21] Appl. No.: 908,637

[22] Filed: Jul. 2, 1992

Related U.S. Application Data

[63] Continuation of Ser. No. 705,292, May 24, 1991, abandoned.

[30] Foreign Application Priority Data

May 25, 1990 [JP] Japan ..... 2-136025
May 25, 1990 [JP] Japan ..... 2-136026

[51] Int. Cl.[5] ..... B63H 11/08
[52] U.S. Cl. ..... 440/41; 440/42
[58] Field of Search ..... 440/38, 40–43, 440/44, 61; 60/221, 222

[56] References Cited

U.S. PATENT DOCUMENTS 4,064,824 12/1977 Hall et al. ..... 440/61

FOREIGN PATENT DOCUMENTS 386760 9/1990 European Pat. Off. ..... 440/42
2732671 2/1979 Fed. Rep. of Germany ..... 440/38
2032871 5/1980 United Kingdom ..... 440/38

*Primary Examiner*—Sherman Basinger
*Attorney, Agent, or Firm*—Ernest A. Beutler

[57] ABSTRACT

Several embodiments of jet propelled watercraft that incorporate an arrangement for hydraulically pivoting the jet propulsion unit between a normal position and a raised position and for rotating the water inlet portion of the jet propulsion unit from a downwardly facing direction to an upwardly facing service position. Hydraulic motors are employed for achieving both motions and are actuated through a common circuit for achieving sequential movement. In one embodiment, the rotary hydraulic motor is formed integrally within portions of the housing of the jet propulsion unit to provide a compact assembly.

29 Claims, 13 Drawing Sheets

WATER JET PROPULSION BOAT

This is a continuation of U.S. patent application Ser. No. 705,292, filed May 24, 1991 and now abandoned.

BACKGROUND OF THE INVENTION

This invention relates to a water jet propulsion unit and more particularly to an improved jet propulsion unit particularly useful in propelling watercraft.

The advantages of jet propelled watercraft are well known. It is also desirable, for a variety of reasons, to position the jet propulsion unit in a tunnel positioned on the underside of the watercraft hull. This provides a neat and smooth appearance. However, due to the ability of jet propelled watercraft to operate in shallow water and for a variety of other reasons, it is desirable to access the water inlet opening of the jet propulsion unit for servicing. Also, to avoid barnacle and other encrustation, it is desirable if the jet propulsion unit can be moved so that its water inlet opening is raised out of the water during times when the watercraft is not being operated. The copending application of Noburo Kobayashi, entitled "Water Jet Propulsion Unit," Ser. No. 489,361, filed March 1990, now abandoned, and assigned to the assignee of this application discloses several embodiments of improved water jet propulsion units wherein a tunnel mounted jet propulsion unit is pivotal about a transverse longitudinal axis and rotatable about a longitudinally extending axis so as to raise the water inlet opening out of the body of water in which the water craft is operating when not in use and also so as to permit accessing of the water inlet opening of the jet propulsion unit through an access opening in the hull.

Although the arrangement disclosed in that copending application is particularly useful in solving the problems attendant with normal jet propulsion unit mountings, there are certain improvements that can be made. For example, in one disclosed embodiment of the aforenoted copending application the rotational movement of the jet propulsion unit is achieved by an electric motor. However, the mounting of the electric motor within the tunnel can give rise to serious corrosion problems. Although that application also mentions the possibility of employing a hydraulic motor for the rotational movement, there is no disclosure of how the hydraulic motor could be interrelated with the other construction.

It is, therefore, a principal object of this invention to provide an improved arrangement for a water jet propulsion unit that is both pivotal about a transverse axis and rotatable about a longitudinal axis and wherein both movements are achieved by a hydraulic system including a pair of hydraulic motors.

It is a further object of this invention to provide a hydraulic system for operating a water jet propulsion unit of the described type from a single power source of hydraulic fluid.

It is also desirable to provide a seal between the water inlet opening of the jet propulsion unit and the hull of the watercraft. Such seals improve the efficiency of the jet propulsion unit and the performance of the watercraft. However, if a seal is employed this seal must accommodate the relative movements aforedescribed. If this is done and if the jet propulsion unit is rotated before it is pivoted, there is a possibility of damage to the seal.

It is, therefore, a further principal object of this invention to provide a jet propulsion unit for a watercraft that is mounted for pivotal movement about a transverse axis and rotary movement about a longitudinal axis and which is power operated for these movements and in which the pivotal movement must occur before rotary movement can be accomplished.

It is a further object of this invention to provide an improved control arrangement for controlling the pivotal and rotary movement of a jet propulsion unit so as to insure that the desired sequence of operation is achieved.

The advantages of employing hydraulic motors for operating the jet propulsion units and particularly their particular types of movements previously described has already been noted. However, the mounting of plural hydraulic motors can present substantial problems bearing in mind the small space available. The external mounting of a hydraulic motor for achieving the rotary movement can present substantial difficulties in this regard.

It is, therefore, a further object of this invention to provide an improved jet propulsion unit having rotatable segments and incorporating an integral hydraulic motor for achieving the rotary motion.

SUMMARY OF THE INVENTION

Certain features of the invention are particularly adapted for use in a jet propelled watercraft having a hull and a jet propulsion unit having a water inlet portion normally facing downwardly for drawing water into the jet propulsion unit from the body of water in which the watercraft is operating, an impeller portion containing an impeller for drawing water through the water inlet portion and a discharge portion for discharging water pumped by the impeller portion back into the body of water in which the watercraft is operating for propelling the hull. The jet propulsion unit is supported for pivotal movement relative to the hull about a generally transversely extending pivot axis and means support at least the water inlet portion of the jet propulsion unit for rotation about a generally longitudinally extending axis.

In accordance with a first feature of the invention, hydraulically operated means effect pivotal movement of the jet propulsion unit and rotary movement of at least the water inlet portion.

In accordance with another feature of the invention, power means effect pivotal movement of the jet propulsion unit and rotary movement of at least the water inlet portion in a sequence so that the jet propulsion unit is first pivoted from a first normal position in which the water inlet portion is facing downwardly and is submerged toward a raised position, then the water inlet portion is rotated from its downwardly facing position to an upwardly facing position. Return to the normal driving position is obtained in the opposite sequence.

Another feature of the invention is adapted to be embodied in a jet propulsion unit for a watercraft that includes a water inlet housing portion having an inlet opening for drawing water from a body of water in which the watercraft is operating. An impeller housing portion contains an impeller for drawing water through the inlet opening. A discharge nozzle housing portion defines a water outlet for returning water back to the body of water for propelling the watercraft. Means journal at least two of the housing portions for relative rotation. These two housing portions have telescoped cylindrical sections and a circumferential groove is defined in one of these sections. A piston is formed on the other of these sections and extends into the circumferential groove to separate the groove into a pair of arcuate variable volume fluid chambers. Means are provided for selectively pressurizing the chambers to effect powered rotation between the housing portions.

DETAILED DESCRIPTION OF THE PREFERRED EMBODIMENTS OF THE INVENTION

Figure 1:
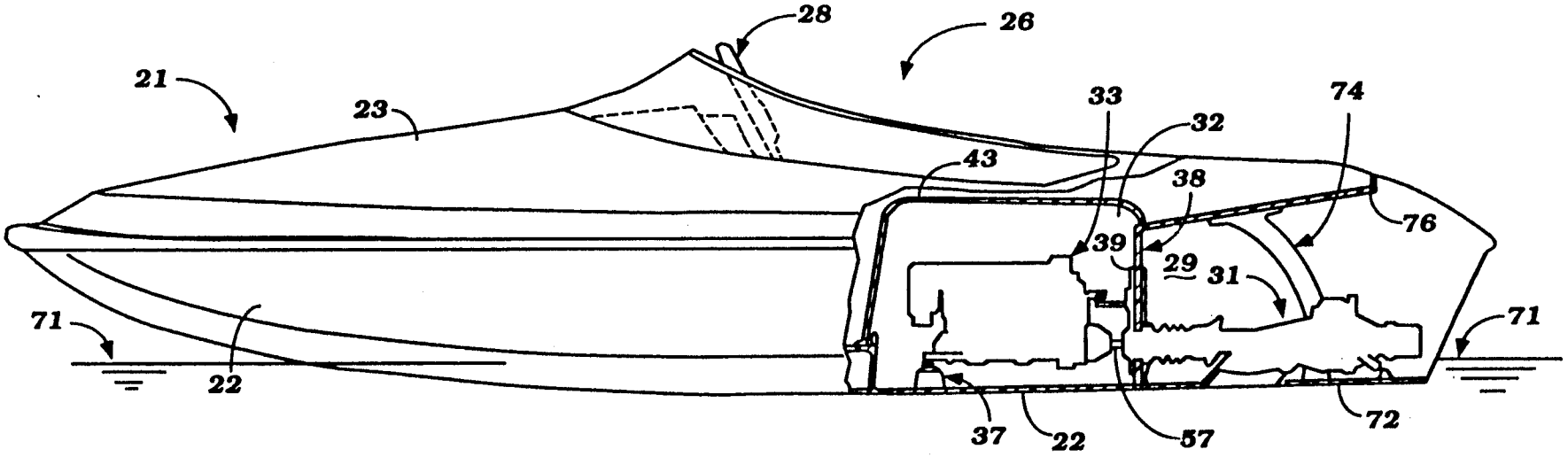
FIG. 1 is a side elevational view of a watercraft having a jet propulsion unit constructed in accordance with a first embodiment of the invention, with a portion broken away to more clearly show the construction.
Figure 2:
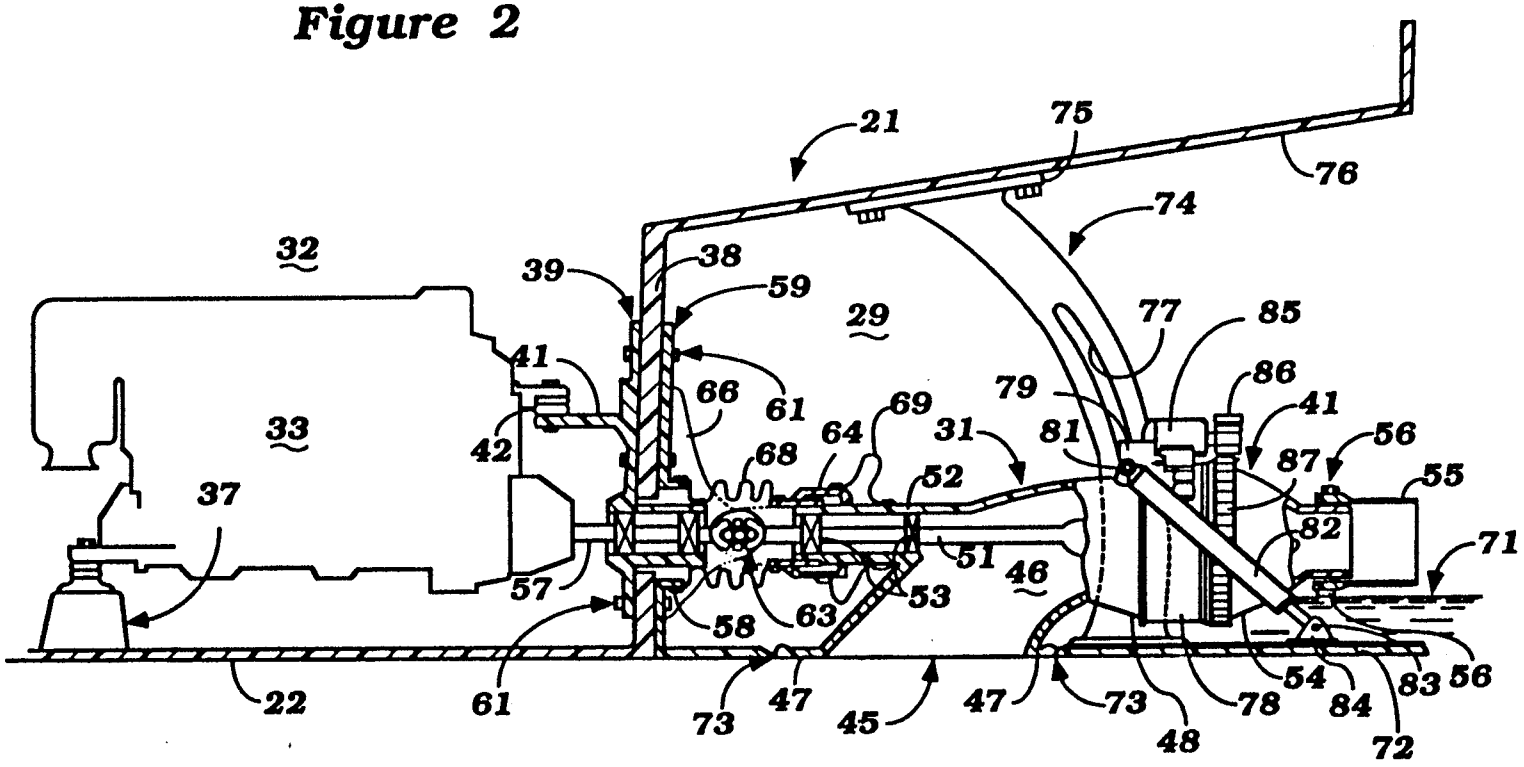
FIG. 2 is an enlarged view of the broken away portion of FIG. 1 showing the jet propulsion unit and the drive therefor.
Figure 3:
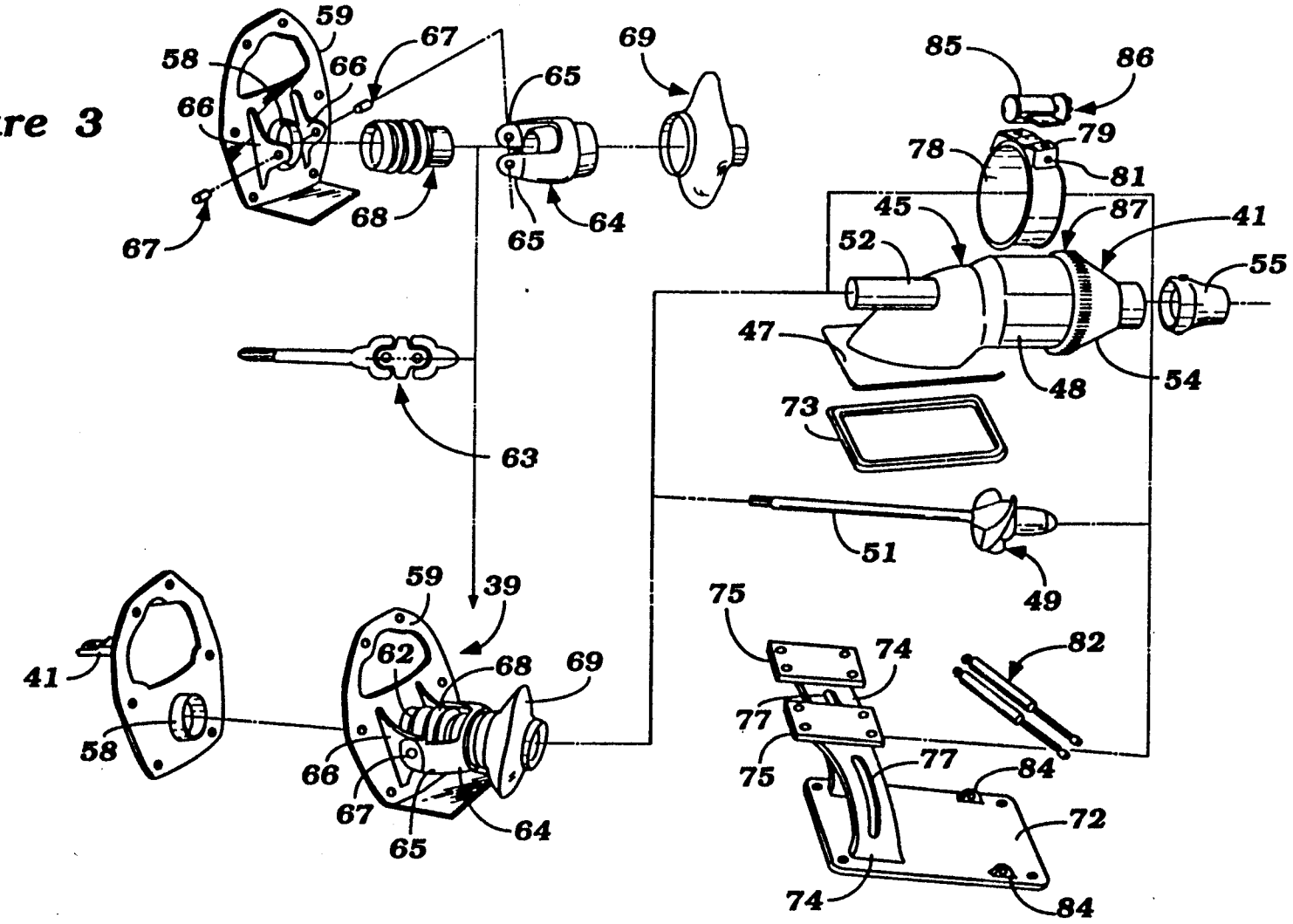
FIG. 3 is an enlarged exploded perspective view of the jet propulsion unit.

Referring first to FIGS. 1 through 3, a watercraft constructed in accordance with an embodiment of the invention and powered by a jet propulsion unit constructed in accordance with certain features of the invention is identified by the reference numeral 21. It should be understood that the hull configuration to be described is only one of many with which the invention can be practiced. The watercraft 21 is comprised of a hull assembly that includes a lower or main hull portion 22 closed by a deck 23. The hull portion 22 and deck portion 23 may be conveniently formed from molded fiberglass reinforced resins. Of course, other materials can be utilized as should be readily apparent.

The hull and deck 22 and 23 define an open rider's compartment 26. Positioned within the open rider's area 26 are a pair of forwardly disposed seats (not shown), one of which is designed to accommodate the operator. A steering wheel 28 is positioned forwardly of this one seat for steering of the watercraft, in a manner which will be described.

The underside of the hull 22 is formed with a central, rearwardly disposed tunnel portion 29 in which a jet propulsion unit, indicated generally by the reference numeral 31 is positioned in a manner to be described. An engine compartment 32 is positioned forwardly thereof and contains an internal combustion engine 33 for driving the jet propulsion unit 31 in a manner to be described.

The engine compartment 32 is formed with a pair of forwardly disposed embossments 37 so as to provide a means of attachment of the forward portion of the engine 33 thereto. The rear end of the engine compartment 33 is defined by a vertically extending bulkhead 38 that separates the engine compartment 32 from the tunnel 29. A bearing plate 39 is affixed thereto that has a forwardly extending portion 41 to which rear engine mounts 42 are affixed for completing the mounting of the engine 33 within the engine compartment 32. The engine compartment is further completed and enclosed by means of a removable engine cover 43 which can be conveniently put in place and removed so as to afford access to the engine 33.

Referring now in detail primarily to FIGS. 2 and 3, it will be noted that the jet propulsion unit 31 is comprised primarily of an outer housing 41 which may be of a unitary or fabricated construction. The outer housing 41 defines a water inlet portion 45 that terminates in a downwardly extending water inlet opening 46 that is defined by a peripheral flange 47. In the normal operating condition, the opening 46 and a portion of the inlet 44 is disposed beneath the normal operating water level.

Rearwardly of the inlet portion 45, the housing 44 defines an impeller housing portion 48 in which an impeller 49 (FIG. 3) is supported for rotation in a suitable manner. The impeller 49 is affixed to an impeller shaft 51 which, in turn, extends forwardly through the water inlet portion 45 and through a cylindrical projection 52 of the housing 44. A pair of water seals 53 are interposed between the impeller shaft 51 and the housing portion 52 so as to prevent leakage.

The impeller housing 48 terminates at its rearward end in a convergent section 54 to which a pivotally supported steering discharge nozzle 55 is journaled about a pair of vertically extending pivot pins 56. The steering nozzle 55 is steered from the steering wheel 28 by a mechanism which will be described in more detail by reference to one of the other embodiments.

The engine 13 drives an output shaft 57 that extends through a cylindrical flange portion 58 of the plate 39. A further support plate 59 is affixed to the rear side of the bulkhead 38 by threaded fasteners 61 which also serve to affix the plates 39 and 59 to the bulkhead 38. The plate 59 also has a cylindrical flange 62 that is telescoped around the flange 58.

At its rear end, the engine driven shaft 58 is connected by means of a universal joint, indicated generally by the reference numeral 63 to the impeller shaft 51. A yoke member 64 has a connection to the forward end of the impeller housing portion 52 and has a pair of bifurcated arms 65 that are pivoted to a pair of rearwardly extending arms 66 of the plate 59 by means of pivot pins 67. As a result of this connection, the entire jet propulsion unit 31 may be pivoted about a transverse horizontally extending axis defined by the pivot pins 67 relative to the hull of the watercraft, for a reason which will be described. An elastic sealing boot 68 encircles the universal joint 63 and provides a watertight seal in this area.

A further flexible sealing boot 69 is provided around the jet propulsion unit portion 52 and the yoke 64 so as to provide good watertight construction while permitting relative rotation of the jet propulsion unit 31 about the axis of the impeller shaft 51 in a manner as will be described. The boots 68 and 69, therefore, act together so as to provide a good watertight seal and so as to permit the movements which will be described.

As should be readily apparent, the jet propulsion unit 31 provides a good power source for the watercraft and nevertheless provides a very neat and clean appearance. When the watercraft 21 is in its normal operating mode, the water inlet portion 45 and inlet opening 46 of the jet propulsion unit 31 will be submerged at least partially below the normal water level in which the watercraft is operating, which water level is shown in the drawings by the line 71. However, as a result of this submersion, foreign material and encrustation can occur on the jet propulsion unit such as barnacle formation. This is not at all desirable. Therefore, an arrangement is provided for pivoting the jet propulsion unit 31 upwardly about the pivot axis described by the pivot pins 67 during periods of time when the watercraft is not in use. This mechanism includes a plate 72 that is affixed to the rear of the hull 22 beneath the tunnel 29 and rearwardly of the water inlet opening 46 of the jet propulsion unit 31.

It should be noted that a seal arrangement 73 is carried by the peripheral flange 47 of the jet propulsion unit housing around the inlet opening 46 for sealing with the hull, the plate 72 and a horizontally extending flange of the plate 59 when the unit is in its normal drive position, as shown in the solid line view of FIG. 2. This is important for insuring good efficiency of the jet propulsion unit 31.

The plate 72 has a pair of upwardly extending arcuate arms 74 that have flanges 75 at their upper end which are secured to the underside of a surface 76 of the hull which defines the tunnel 29. The arms 74 have arcuately shaped slots 77 which extend along a radius defined by the pivot points defined by the pins 67 that pivotally journal the jet propulsion unit 31. A support ring 78 encircles the jet propulsion unit and specifically the impeller housing portion 48 and journals it for rotation about an axis that is coincident with the rotational axis of the impeller shaft 51. The support ring 78 has a bracket portion 79 affixed to its upper end and which receives a pair of pins 81 for slidably supporting the support ring 78 in the slots 77 of the arms 74. In addition, a pair of hydraulic cylinders 82 are pivotally connected at one end to the pins 81 and at their opposite ends, by means of further pins 83 to a pair of lugs 84 formed on the plate 72.

Figure 11:
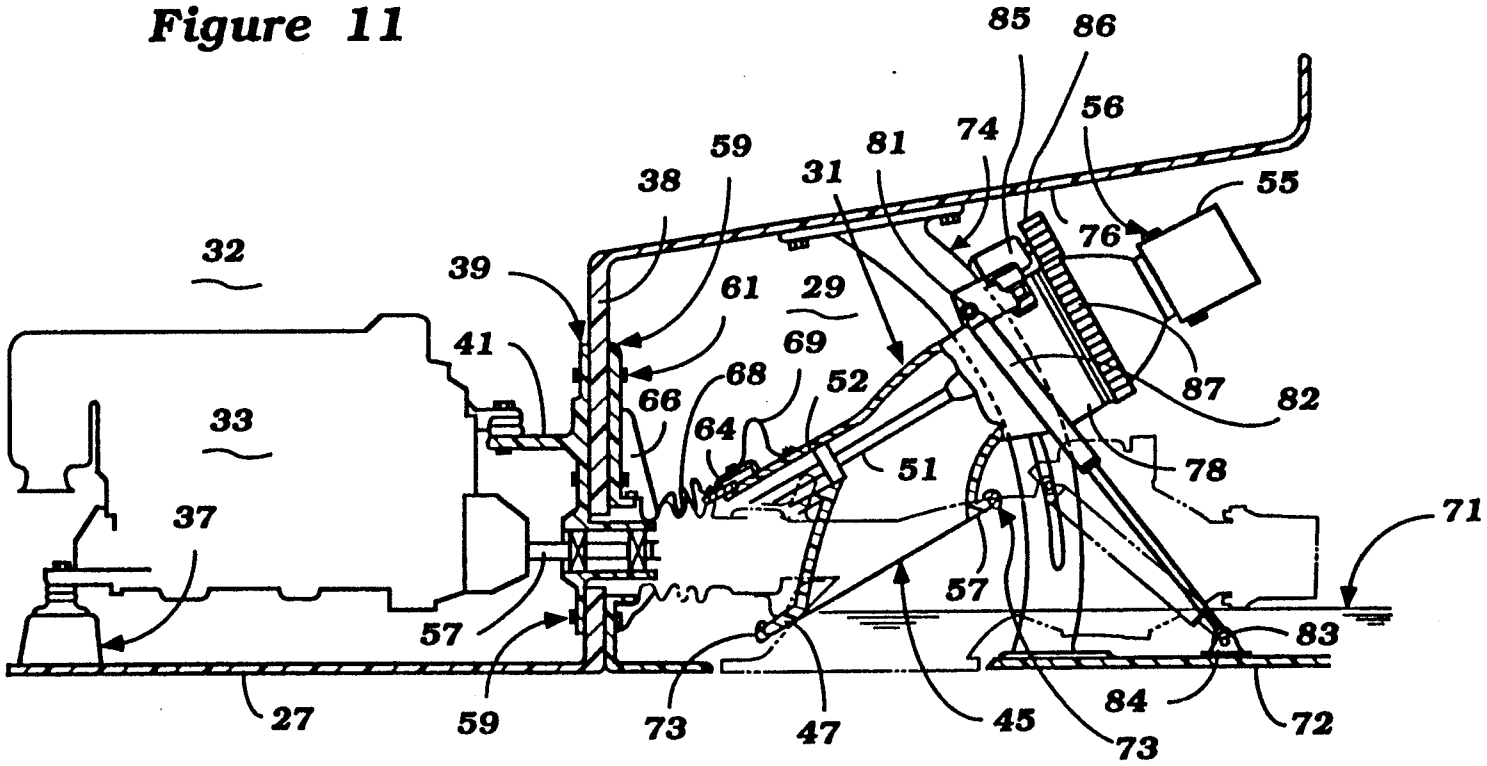
FIG. 11 is a view, in part similar to FIG. 2, and shows the position of the jet propulsion unit when it is first lifted from its operative position, as shown in phantom lines to its out of the water position as shown in solid lines.

When the cylinders 82 are extended or retracted, the jet propulsion unit 31 will be pivoted about the first axis defined by the pins 67 which are aligned with the universal joint 63 between its lower normal position as shown in FIG. 2 to a raised or out of the water storage, service position as shown in FIG. 11. When so raised, the unit opening 46 will be disposed above the water level 71 and hence the jet propulsion unit 31 will be raised out of the water and the problems as aforenoted will not occur. In addition, all water will drain out of the jet propulsion unit 31 and this will provide assurance against any problems.

Figure 12:
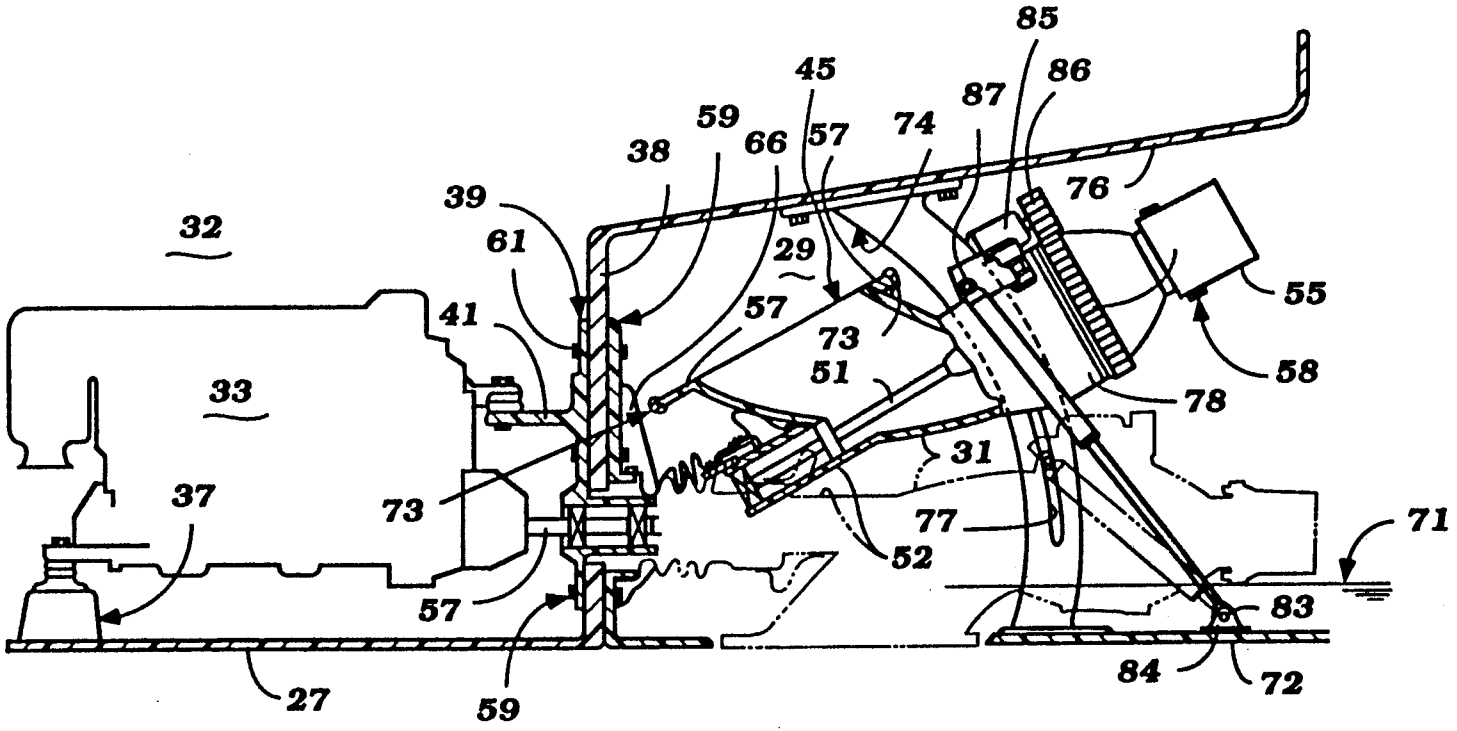
FIG. 12 is a view, in part similar to FIGS. 2 and 11, and shows the jet propulsion unit rotated to its service position.

In order to provide further assurance against water damage when the watercraft is not being operated and also so as to afford access for servicing, the jet propulsion unit 31 may be rotated about the aforedescribed rotational axis defined by the support ring 78. To this end, a hydraulic motor 85 is supported on the bracket 79 of the support ring 78 and has a driven gear 86 that is enmeshed with a ring gear 87 formed on the jet propulsion unit 31. When the motor 85 is operated, the entire jet propulsion unit 31 will rotate about the axis of the impeller shaft 51 while the boot 69 torsionally deflects so that the unit 31 may be positioned so that the water inlet portion 45 and inlet opening 46 instead of facing downwardly face upwardly as shown in FIG. 12. This will place the inlet opening 45 in such a direction that water cannot inadvertently enter the jet propulsion unit when it has been elevated. A pair of suitable stops (not shown) are provided to limit the rotation of the jet propulsion unit 31 upon the operation of the motor 85 in both its downwardly facing position and its upwardly facing position.

Figure 13:
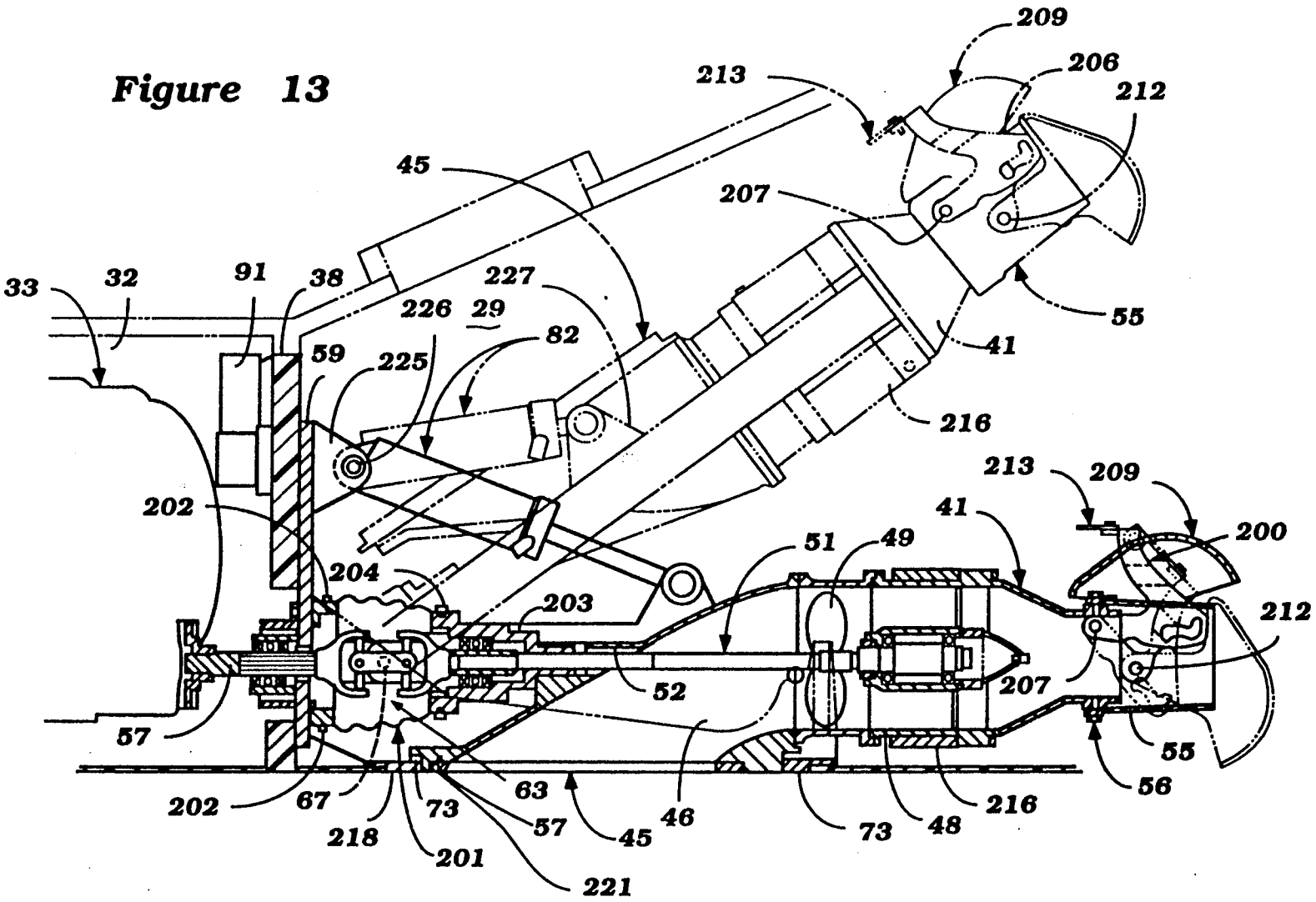
FIG. 13 is a cross-sectional view, in part similar to FIGS. 2 and 11, and shows another embodiment of the invention.

This rotation also gives rise to the ability to service the unit by removing foreign particles from the impeller housing through the opening 46. To accomplish this, there is provided an access opening (not shown in the figures of this embodiment but which may have a construction as shown in the embodiment of FIG. 13) in the hull portion 76 that has an access door for servicing.

The arms 45 in addition to providing a path of movement for the jet propulsion unit 31 as it pivots about the axis defined by the pivot pins 67, also serve to take side thrusts from the jet propulsion unit during its operation. Thus, the assembly is quite rigid even through the jet propulsion unit 31 may pivot both about a horizontally extending transverse axis and a longitudinally extending horizontal axis.

Figure 4:
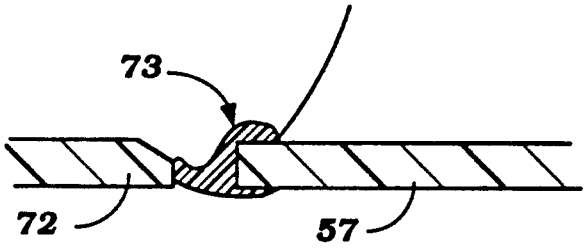
FIG. 4 is a further enlarged cross-sectional view showing one embodiment of seal arrangement between the inlet portion of the jet propulsion unit and the hull.
Figure 5:
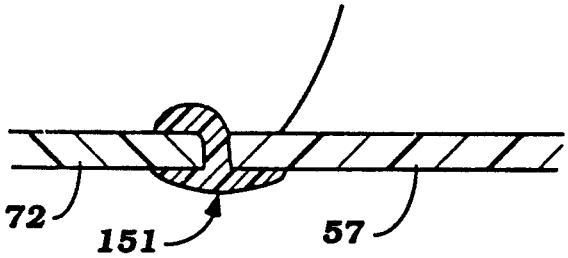
FIG. 5 is a cross-sectional view, in part similar to FIG. 4 and shows another embodiment of the invention.
Figure 6:
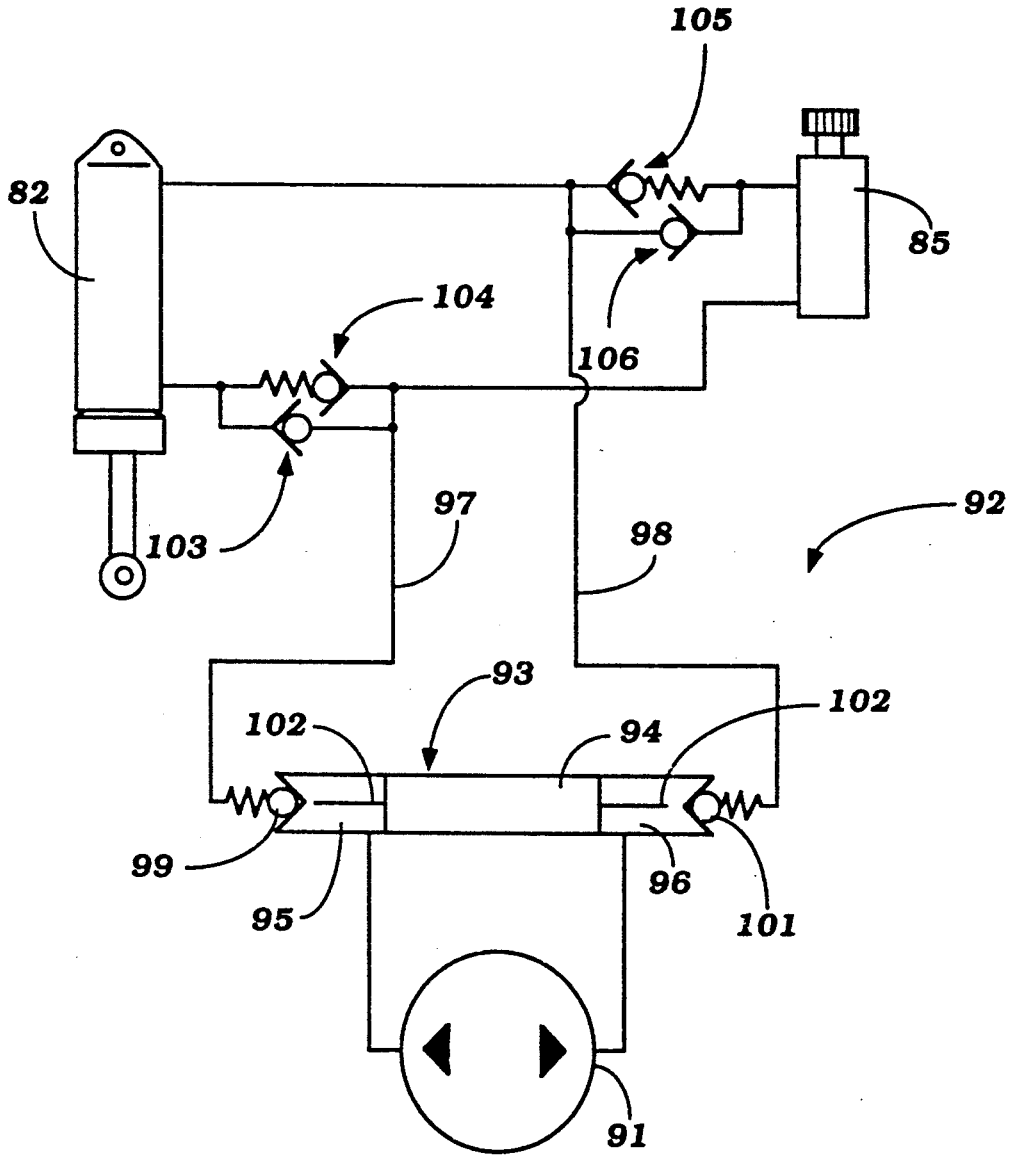
FIG. 6 is a schematic view showing the hydraulic circuit associated with the jet propulsion unit.
Figure 7:
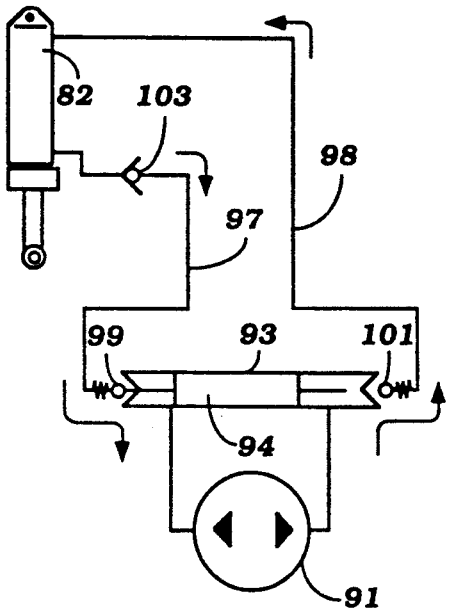
FIGS. 7 through 10 are partially schematic views of the hydraulic circuit showing the operation during raising and rotation of the jet propulsion unit and subsequent counter rotation and lowering thereof.
Figure 8:
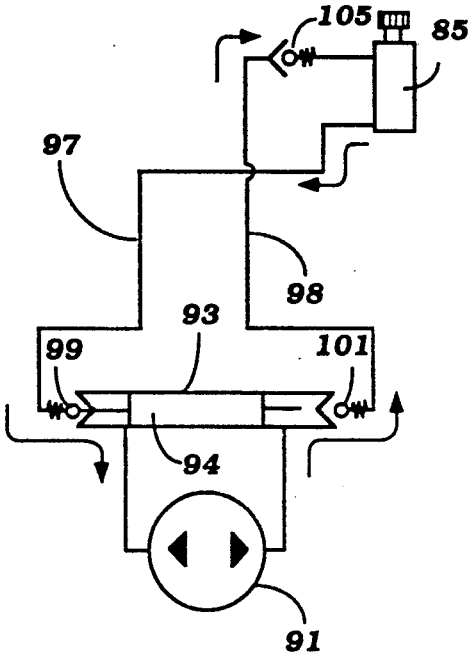
Figure 9:
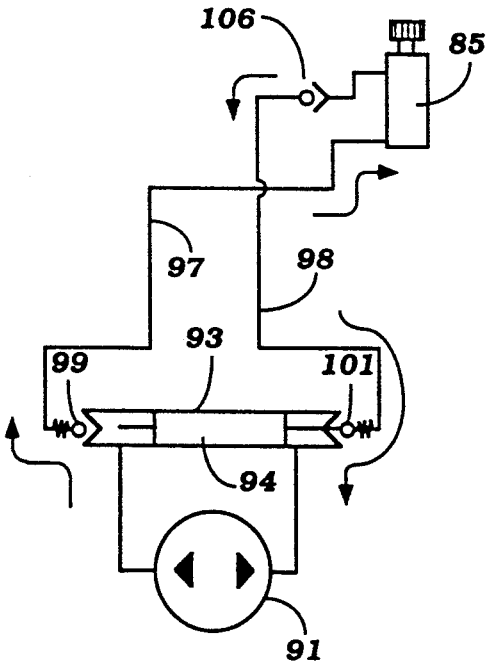
Figure 10:
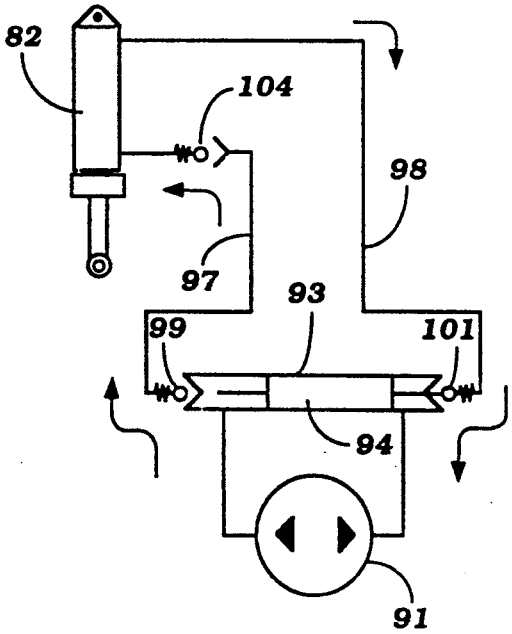

As may be best seen from FIG. 4, the seal 73 and its cooperation with the hull is such that it is desirable to first tilt the jet propulsion unit 31 about the horizontal transverse axis defined by the pivot pins 67 before rotation of the jet propulsion unit 31 occurs. Also, it is desirable to provide hydraulic motors for operating both the tilting and rotational movement, as have been described. In accordance with the invention, a hydraulic system is provided for operating the hydraulic tilt motors 82 and the rotational motor 85 and for operating these motors in a sequence so that the desired range of movement may occur. This construction will now be described by particular reference to FIGS. 6 through 10. In these figures, the hydraulic motors 82 and 85 are illustrated along with the operating schematic system. This system includes a reversible fluid pump, shown schematically at 91 which is driven by a reversible electric motor (not shown in this embodiment). This pump and motor assembly may be conveniently mounted on the forward side of the bulkhead 38 and specifically upon the mounting plate assembly 39. It is desirable to position these components out of the tunnel 29 so that the electrical components will not be adversely affected in the marine environment.

The hydraulic system is indicated generally by the reference numeral 92 and includes the pump 91 and reversible driving motor previously referred to. In addition, a remote switch assembly may be positioned in proximity to the steering wheel 28 which will let the operator select either the normal running mode as shown in FIGS. 1 and 2 or the out of the water service mode as shown in FIG. 12. In accordance with the invention, the system operates so that once the operator initiates the switch to achieve this operation, the hydraulic motors 82 will be operated from the position shown in the aforenoted normal positions to the elevated position as shown in FIGS. 11 and 12. Then the hydraulic motor 85 will be operated so as to rotate the jet propulsion unit between the downwardly facing position of FIG. 11 to the upwardly facing service position of FIG. 12.

The hydraulic circuit incudes a shuttle valve assembly, indicated generally by the reference numeral 93 which includes a shuttle piston 94 which divides the shuttle valve 93 into a pair of opposite chambers 95 and 96. The chambers 95 and 96 selectively communicate with conduits 97 and 98 through passageways in which check valves 99 and 101 are positioned. The shuttle piston 94 has pin projections 102 that are adapted to engage the check valve 99 and 101 and unseat them, in a manner which will be described.

The conduit 97 extends to the side of the fluid motors 82 which must be energized so as to lower the jet propulsion unit to pivot about the pivot pin 67 from its raised position to its lowered position. The conduit 97 communicates with this side of the fluid motors 82 through a check valve assembly including a check valve 103 which permits flow from this chamber of the fluid motors 82 back to the conduit 97 on small pressure differences and a pressure release valve 104 that permits flow from the conduit 97 to the motor chamber 82 when more than a predetermined pressure is existent.

The fluid motor 85 may be any known type of reversible fluid motor and has a first port that is a rotate up port that is in communication with the conduit 98 through a pressure responsive check valve 105 which opens at a relatively high pressure, corresponding to the pressure of the check valve 104 and a relatively light return check valve 106 that permits flow in the opposite direction. The other port of the fluid motor 85 is in communication directly with the conduit 97.

Assuming that the unit is in its normal operative position wherein there has been tilt down about the pivot pin 67 and rotation of the jet propulsion unit 31 so that the water inlet opening 46 is downwardly facing, and the operator wishes to raise the jet propulsion unit out of the water either for storage or servicing, the aforenoted switch is energized so as to operate the fluid pump 91 in a direction so that the conduit 98 is pressurized. When this conduit is pressurized (FIG. 7) the pressure in the shuttle valve 93 will cause the shuttle piston 94 to move to the left and unseat the check valve 99. In addition, the high pressure in the opposite chamber acting on the shuttle piston 94 will unseat the check valve 101 and the conduit 98 will be pressurized. Pressure will then be transmitted to the fluid motors 82 on the chamber side that causes tilt up operation. When this occurs, the check valve 105 (FIGS. 6 and 8) in the line to the fluid motor 85 will be closed. The check valve 105 is set to open at a relatively high pressure, as aforenoted.

The fluid motors 82 will expand and fluid will be discharged back to the inlet side of the pump 91 through the conduit 97 upon opening of the lightly biased check valve 103. This fluid then flows past the held open check valve 99 of the shuttle valve 93 back to the inlet side of the pump 91. This operation will continue until the cylinders 82 have fully expanded and the jet propulsion unit 31 is tilted up to position shown in FIG. 11.

When this occurs, there will be a relatively high pressure rise in the line 98 and then the check valve 105 will open and energize the motor 85 so as to rotate the jet propulsion unit 31 from its FIG. 11 position to its FIG. 12 position. The operation of the fluid pump 91 should then be stopped. This can be done either manually or through the use of an appropriate pressure actuated switch in the conduit 98 which will operate to shut off the electric motor driving the fluid pump 91. In addition, some form of relief valve may also be incorporated so as to prevent over pressure conditions under these circumstances.

When the fluid motor 85 is being driven in the rotate up position, fluid discharged from the fluid motor 85 on the return side will return to the pump 91 through the conduit 97 through the previously described return path which is common to that of the fluid motors 82.

If the operator desires to place the watercraft 21 back in use, then the aforenoted switch is operated to the operating position. When this occurs, the fluid pump 91 is driven in the opposite direction by the aforenoted reversible electric motor and the left hand side of the shuttle valve 93 (FIG. 9) will be pressurized. When the pump 91 is energized in this fashion, the shuttle piston 94 will move to the right and unseat the check valve 101. At the same time, the pressure in the shuttle valve chamber to the left of the shuttle piston 94 will unseat the check valve 99 and pressurize the line 97. At this time, fluid will be delivered to the motor 85 to drive it in the rotate down position. When this occurs, pressure will also be exerted on the pressure responsive valve 104 leading to the fluid motors 82. Since the valve 104 opens at a higher pressure, however, no fluid will be delivered to the fluid motors 82 under this operation.

The fluid discharged from the fluid motor 85 due to the rotate down operation will be returned to the return side of the pump 91 through the opening of the light check valve 106, conduit 98, and past the open check valve 101.

Once the jet propulsion unit 31 is rotated back to the position shown in FIG. 11, then there will be an abrupt pressure rise in the line 97. This increased pressure will then overcome the spring and open the check valve 104 so as to permit hydraulic fluid to be delivered to the fluid motors 82 so as to permit their tilt down operation. When this occurs, fluid is returned back to the inlet side of the pump 91 through the conduit 98 and the same circuit as the return circuit from the fluid motor 85. However, no fluid can be delivered to the fluid motor 85 to cause rotation since the pressure responsive valve 105 will be closed and the check valve 106 precludes reverse flow. Hence, tilt down operation will occur until the jet propulsion unit 31 is again returned to the position shown in FIG. 2. At this time, the operation should be stopped. This can be done either manually or through an appropriate pressure responsive switch, of the type as aforenoted.

It should be readily apparent that the described construction is affective in insuring that the entire system is hydraulically operated and that it will operate in the proper sequences so that both fluid motors can be operated from a single fluid pump.

Rather than a seal of the shown in FIG. 4, a different seal, as indicated by the ref numeral 151 may be employed. The seal 151 also operates best if the jet propulsion unit 31 is tilted and rotated in the aforedescribed sequence.

In the embodiments of the invention as thus far described, the entire jet propulsion unit has been rotated in order to rotate the inlet opening 46 to its upward facing service position and out of the water. Rather than rotating the entire jet propulsion unit, it is also possible to rotate only a portion of the jet propulsion unit. FIGS. 13 through 18 show such an embodiment. In these figures, many of the components are the same as those previously described and where that is the case these components have been identified by the same reference numerals. In this embodiment, particularly because of the nonrotational characteristics of some of the jet propulsion unit, it can be mounted for its tilting movement in a different fashion. In addition, a single flexible boot, indicated generally by the reference numeral 201, may be employed that is held to the mounting bracket flange 62 by means of a clamp 202 and to an extension of the support tube 52, which extension is identified generally by the reference numeral 203 by means of a clamp 204. Overall construction of the jet propulsion unit of this embodiment is substantially the same as the construction shown in the copending application of Noburo Kobayashi, entitled "Water Jet Propulsion Boat," Ser. No. 680,709, filed Apr. 4, 1991 and assigned to the assignee hereof. That disclosure is herein incorporated by reference.

Figure 14:
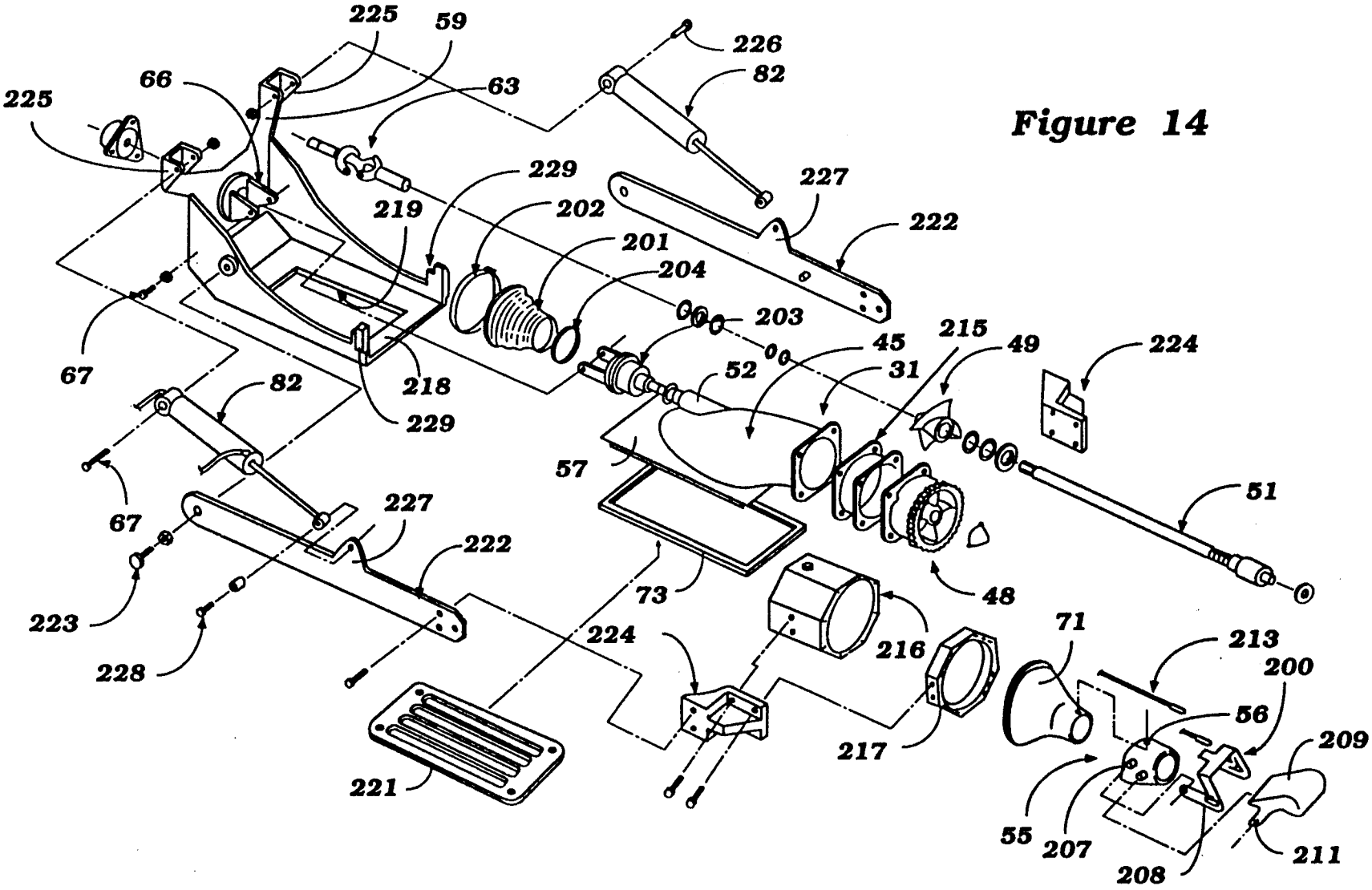
FIG. 14 is an exploded perspective view of the jet propulsion unit of this embodiment.
Figure 15:
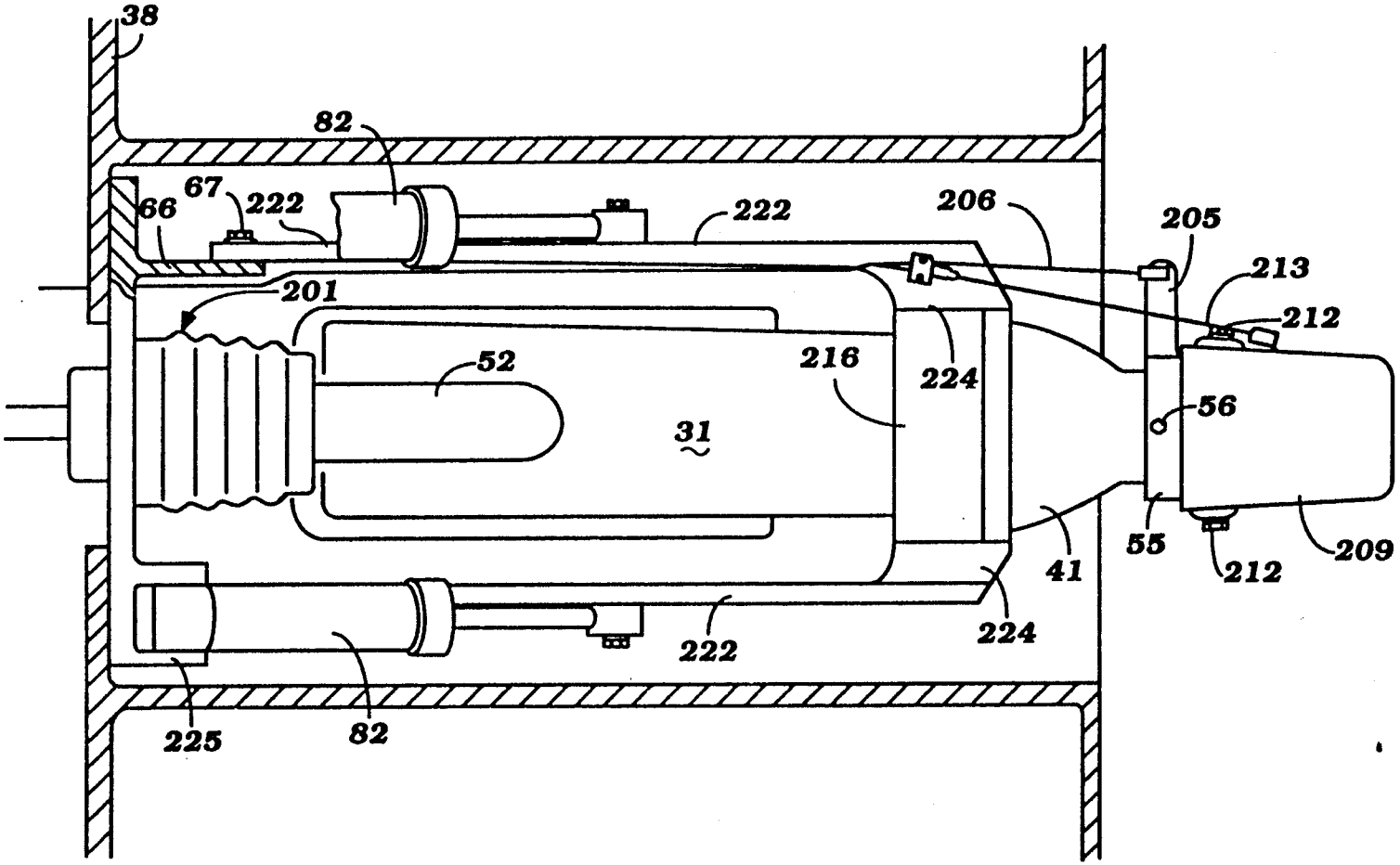
FIG. 15 is a cross-sectional view taken through the tunnel of the watercraft and shows the jet propulsion unit in place.
Figure 16:
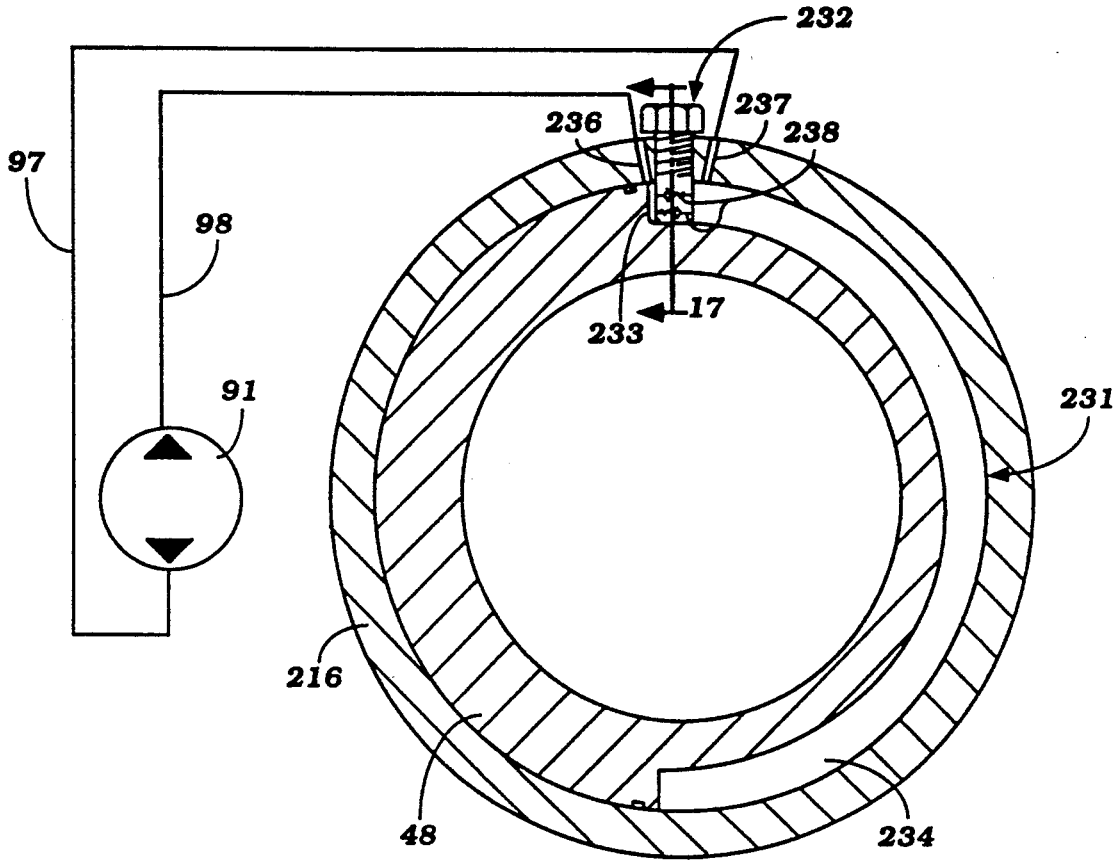
FIG. 16 is a vertical cross-sectional view taken through the jet propulsion unit with a portion of the associated hydraulic circuit being shown schematically.
Figure 17:
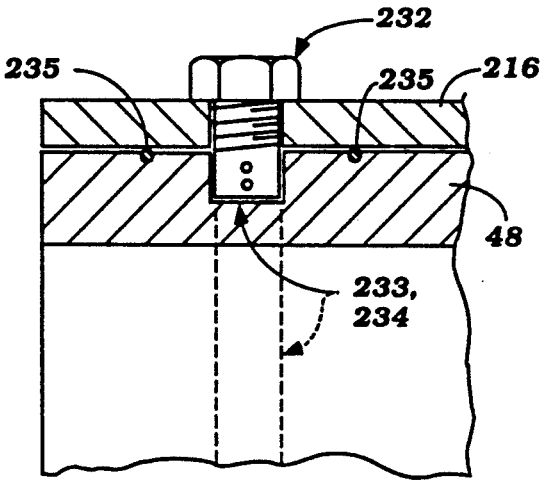
FIG. 17 is a cross-sectional view taken along the lines 17—17 of FIG. 16.
Figure 18:
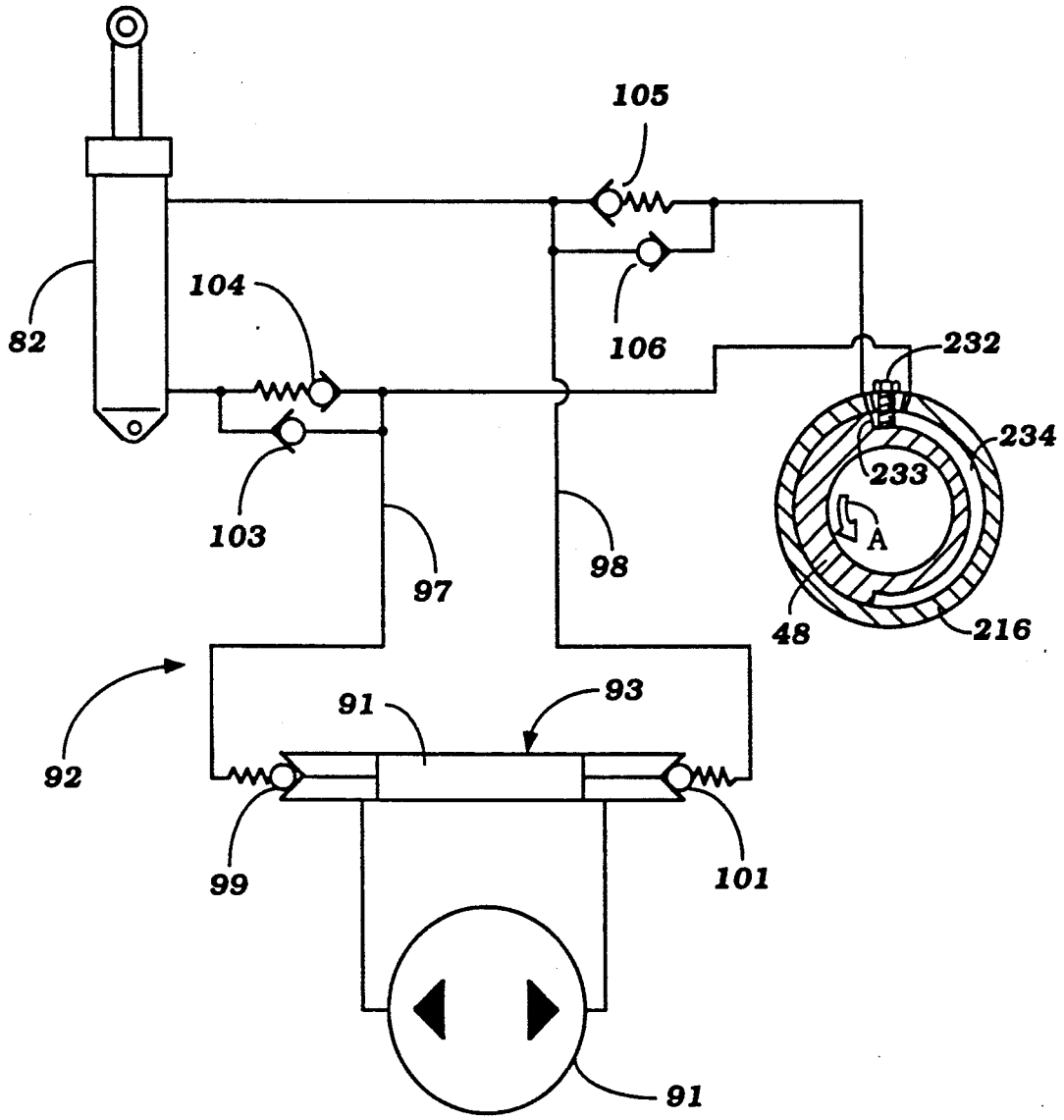
FIG. 18 is a schematic view showing the hydraulic system of this embodiment.

In this embodiment, the steering control for the steering nozzle 55 appears in FIG. 15 wherein there is a lever 205 that extends from one side of the steering bracket and which is connected by means of a boden wire cable 206 to the steering wheel 28 in a known manner. In addition, this embodiment includes a reverse thrust bucket assembly for redirecting the flowout of the steering nozzle 55 so as to achieve reverse watercraft operation, if desired. This reverse thrust bucket assembly includes a mounting bracket 200 (FIG. 14) that is pivotally mounted to a pair of bosses 207 on opposite sides of the steering nozzle 55. This bracket 200 has a pair of slots 208 that receive follower pins that are affixed to a reverse thrust bucket 209 and which reverse thrust bucket is pivotally supported on the steering nozzle 55 by means of pivot pins 212. The mounting lever 200 is connected to a boden wire actuator 213 which extends to a remote location (not shown) for operation by an operator. When the wire actuator 213 is pulled, the lever 200 will pivot and cam the reverse thrust bucket 209 from the forward drive position to the reverse drive position. Return to forward operation is obtained in the opposite manner.

Because of the incorporation of the reverse thrust bucket and also because of the steering nozzle arrangement it is desirable if the water inlet portion 45 of the jet propulsion unit may be rotated to its upward position without rotating the remainder of the jet propulsion unit. This is accomplished in a manner which will be described.

In this embodiment, the water inlet housing portion 45 and impeller housing portion 48 are affixed to each other with an interposed joining gasket assembly 215 as may be best seen in FIG. 14. A support ring 216, which is supported in a manner to be described, encircles the impeller housing 48 and rotatably journals it and the water inlet portion 45 for rotation about an axis coincident with that of the impeller shaft 51. Affixed to the support ring 216 is a further ring 217 to which, in turn, the discharge nozzle portion 45 is affixed. As a result of this construction, the discharge nozzle 41 is held against rotation by the support ring 216 and retaining ring 217 while the impeller section 48 and water inlet portion 45 may rotate.

In this embodiment, the mounting plate 59 has a rearwardly extending cradle portion 218 which, in effect, forms an extension of the arms 66 of the previously described embodiment. The portion 218 defines an opening 219 which cooperates with the water inlet opening flange 57 and the seal 73 carried thereby for sealing purposes. A strainer plate 221 may be affixed to the underside of the water inlet opening portion 45 of the jet propulsion unit in any suitable manner.

A pair of support arms 222 are pivotally connected at their forward ends on the bracket 59 by means of pivot pins 223. The rear ends of these support arms 222 have affixed to them mounting blocks 224 which mounting blocks 224 are appropriately fixed to opposite sides of the support ring 216 so as to provide a rigid unitary assembly which will pivot relative to the pivot pins 223. The pivot axis of the pivot pins 223 is aligned with the pivot axes of the pivot pins 67 so that pivotal movement of the jet propulsion unit 31 about these pivot axes will be smooth and unencumbered.

The hydraulic lift cylinders 82 of the previously described embodiment are, in this embodiment, pivotally connected at one end to trunions 225 of the mounting plate 59 by means of pivot pins 226. The piston rods of the fluid motors 82 are connected to upwardly extending bosses 227 of the arms 222 by means of further pivot pins 228. As a result, expansion and retraction of the fluid motors 82 will effect pivotal movement of the arms 222 and of the jet propulsion unit 31 as a unit, as in the previously described embodiment.

In this embodiment, the mounting plate portion 218 has a pair of upstanding posts 229 that cooperate with the jet propulsion unit to retain it in position and to take transverse thrusts when in the normal driving mode.

In this embodiment of the invention, an improved rotary motor is incorporated for achieving rotary movement of the water inlet portion 45 and the impeller portion 48. This construction may be best understood by reference to FIGS. 16 through 18. It should be noted that the support ring 216, which forms a portion of the steering ring nozzle 41 through its connection through the ring 217 has a portion that telescopes over the impeller housing 48. The telescope portion of the impeller housing 48 is formed with a circumferential groove 231. A piston formed by a threaded member 232 extends into the groove 231 and divides it into a pair of fluid chambers 233 and 234. A pair of O-ring seals 235 provide a seal between the axial ends of the chamber 231 so as to insure against leakage of hydraulic pressure. Ports 236 and 237 are formed in the support member 216 and communicate with opposite sides of the threaded piston 232 for pressurizing the chambers 233 and 234, respectively. The ports 236 and 237 are in fluid communication with the conduit 97 and 98 and pump 91 as shown schematically in FIG, 16 but in full circuit in FIG. 18.

The figures of this embodiment show the hydraulic system and jet propulsion unit 31 in their normal tilted down rotated down running condition. If an operator decides to raise and rotate the jet propulsion unit 31, he operates a switch, as aforedescribed, so as to operate the pump 91 so as to pressurize the right hand side of the shuttle piston 91 of the shuttle valve assembly 93 and thus pressurize the line 98. This will deliver pressure first to the hydraulic cylinders 82 so as to tilt the jet propulsion unit 31 upwardly. The check valve 105 prevents any pressurization of the chamber 233 under this condition and until the jet propulsion unit 31 is fully tilted up. At this point and time, the pressure rise in the chamber 98 will be sufficient so as to unseat the check valve 105 and pressurize the chamber 233 on one side of the threaded piston 232. When this occurs, the impeller housing 48 and water inlet housing portion 45 will rotate in a counterclockwise direction and elevate the water inlet opening 46 to its service position wherein it can be accessed through the opening afore-referred to and shown in phantom in FIG. 13. Fluid displaced from the chamber 234 is returned back to system in the manner as would the previously described embodiment when this occurs.

It should be readily apparent return to normal running condition is obtained in the manner previously described by pressurizing the line 97 and having line 98 act as a return line.

In connection with this embodiment, a pair of oppositely acting check valves 238 may be provided in the threaded piston 232 and which operate in opposite directions and which open at pressures higher than the pressures at which the valves 104 and 105 operate. These oppositely acting check valves 238 can operate as a pressure relief valve in the system.

In all of the embodiments of the invention as thus far described, the sequence of operation has been such that the tilt motors 87 have been operated first through their full range of stroke to tilt up the jet propulsion unit before either the motors 85 or 231 have been actuated to the water inlet portion from its downwardly facing position to its upwardly facing position and vice versa. Of course, in order to achieve quicker operation all that need be done is that the tilt motors 82 be operated sufficiently so as to move the seal 73 away from its sealing engagement before rotation is started. In this regard, in all embodiments the seal 73 is carried by the water inlet portion of the jet propulsion unit. Obviously, the construction could be reversed so that the seal would be carried by the hull and engage the inlet of the jet propulsion unit.

In either event, a sequence of operation may be employed wherein the tilt motors 82 are operated during raising motion sufficiently to tilt the jet propulsion unit 31 upwardly so as to remove the seal from its sealing engagement and then the tilt motors 82 and rotating motors either 85 or 231 can be actuated through their full cycle while the tilt motors 82 complete their operation. If such an arrangement is employed, the motors 85 or 231 should be constructed and arranged in such a way that they can achieve full rotation during the remainder of the tilt operation to complete the raising of the jet propulsion unit. Of course, the reverse operation would be the same. That is, the rotary motors 85 or 231 will rotate through their full stroke while the tilt motors 82 move downwardly with the rotation completed before the seal is engaged. When the term "sequential operation" is used herein and in the claims, it is intended to cover both types of arrangements.

This sequential operation wherein the tilt motors 82 and rotary motors 85 and 231 operate simultaneously during a portion of the operation of the tilt motors 82 can be achieved in a wide variety of fashions. For example, in the circuits illustrated, the pressure responsive valves 104 and 105 can be replaced by electrically or mechanically operated valves that are responsive to the position of the tilt motor 82 and the position of the rotary motor 85 or 231 or of the rotational phase of the jet propulsion unit. It is believe well within the scope of those skilled in the art to provide such timing arrangements.

It should be readily apparent from the foregoing description that the embodiments of the invention described are very effective in permitting hydraulic actuation for both the tilt and rotational operation of the jet propulsion unit. The jet propulsion unit may be rotated either as a unit or by rotating segments of it. Furthermore, a very compact hydraulic arrangement and motor is provided in one embodiment that minimizes the spacial requirements of the system. Of course, the foregoing description is that of preferred embodiments of the invention and various changes and modifications may be made without departing from the spirit and scope of the invention, as defined by the appended claims.

What is claimed is:

1. A jet propelled watercraft having a hull, a jet propulsion unit having a water inlet portion normally facing downwardly for drawing water into said jet propulsion unit form the body of water in which said watercraft is operating, an impeller portion containing an impeller for drawing water through said water inlet portion and a discharge portion for discharging water pumped by said impeller back to the body of water in which said watercraft is operating for propelling said watercraft, means for supporting said jet propulsion unit for pivotal movement relative to said hull about a generally transversely extending pivot axis, means for supporting at least said water inlet portion of said jet propulsion unit for rotation about a generally longitudinally extending axis, a first hydraulic motor for effecting the pivotal movement of said jet propulsion unit, a second hydraulic motor for effecting rotary movement of at least said water inlet portion of said jet propulsion unit, and a common pressure source for operating said first and second hydraulic motors through a hydraulic actuating circuit.

2. A jet propelled watercraft according to claim 1 further including means for effecting first pivotal movement of the jet propulsion unit from its normal position to a raised position and then rotary motion of the water inlet portion of the jet propulsion unit from its downwardly facing position to an upwardly facing service position.

3. A jet propelled watercraft according to claim 2 wherein the sequence of operation is achieved in the hydraulic actuating circuit.

4. A jet propelled watercraft according to claim 3 wherein the first hydraulic motor has a tilt up chamber and a tilt down chamber and the second hydraulic motor has a rotate up chamber and a rotate down chamber, said hydraulic actuating circuit includes a first conduit extending to said tilt up chamber of the first hydraulic motor and a second conduit extending to said tilt down chamber of the first hydraulic motor and to said rotate down chamber of the second hydraulic motor.

5. A jet propelled watercraft according to claim 4 further including a first pressure response check valve in a portion of the portion of the hydraulic actuating circuit extending to the rotate up chamber of the second hydraulic motor and a second pressure response check valve in a portion of the second conduit extending to the tilt down chamber of the first hydraulic motor for achieving the sequence of operation.

6. A jet propelled watercraft according to claim 2 wherein the raised position of the jet propulsion unit comprises a fully elevated out of the water position.

7. A jet propelled watercraft according to claim 1 wherein the entire jet propulsion unit rotates.

8. A jet propelled watercraft according to Claim 1 wherein the water inlet portion of the jet propulsion unit rotates relative to another portion of the jet propulsion unit.

9. A jet propelled watercraft according to Claim 8 wherein the second hydraulic motor is mounted externally of the jet propulsion unit.

10. A jet propelled watercraft according to claim 8 wherein the second hydraulic motor is formed integrally with the jet propulsion unit.

11. A jet propelled watercraft according to Claim 10 wherein the second hydraulic motor comprises a circumferential chamber formed in a housing portion of the jet propulsion unit and a piston fixed to another housing portion of the jet propulsion unit and dividing the circumferential chamber into a pair of separated fluid chambers.

12. A jet propelled watercraft according to Claim 11 wherein the piston is provided with a pair of oppositely directed relief valves.

13. A jet propelled watercraft according to Claim 1 wherein the hull is provided with a tunnel in which the jet propulsion unit is contained and wherein the hull has an access opening through the hull for accessing the water inlet portion when rotated.

14. A jet propelled watercraft according to Claim 13 further including seal means interposed between the water inlet portion and the hull when the jet propulsion unit is in its normal operating position.

15. A jet propelled watercraft according to claim 14 further including means for effecting first pivotal movement of the jet propulsion unit from its normal position to a raised position and then rotary motion of the water inlet portion of the jet propulsion unit from its downwardly facing position to an upwardly facing service position.

16. A jet propelled watercraft according to claim 15 wherein the sequence of operation is achieved in the hydraulic actuating circuit.

17. A jet propelled watercraft according to claim 16 wherein the first hydraulic motor has a tilt up chamber and a tilt down chamber and the second hydraulic motor has a rotate up chamber and a rotate down chamber, said hydraulic circuit includes a first conduit extending to said tilt up chamber of said first hydraulic motor and to said rotate up chamber of said second hydraulic motor and a second conduit extending to said tilt down chamber of said first hydraulic motor and to said rotate down chamber of said second hydraulic motor.

18. A jet propelled watercraft according to claim 17 wherein the raised position of the jet propulsion unit comprises a fully elevated out of the water position.

19. A jet propelled watercraft according to claim 15 wherein the raised position of the jet propulsion unit comprises a fully elevated out of the water position.

20. A jet propelled watercraft having a hull, a jet propulsion unit having a water inlet portion normally facing downwardly for drawing water into said jet propulsion unit from the body of water in said watercraft is operating, an impeller portion containing an impeller for drawing water through said water inlet portion and a discharge portion for discharging water pumped by said impeller back into the body of water in which said watercraft is operating for propelling the watercraft, means for supporting said jet propulsion unit for pivotal movement relative to said hull about a generally transversely extending pivot axis from a first lowered position to a second raised position, means for supporting at least said water inlet portion of said jet propulsion unit for rotation about a generally longitudinally extending axis between a first downwardly facing position and a second out of the water position, and power operated and control means for automatically (1) effecting at least initial pivotal movement of said jet propulsion unit from its lowered position while at least said water inlet portion is retained in its first position and subsequently rotating at least said water inlet portion into its second position and (2) effecting rotary movement of at least said water inlet portion from its second position to its first position before said jet propulsion unit is returned to its first lowered position.

21. A jet propelled watercraft according to claim 20 wherein the hull is provided with a tunnel in which the jet propulsion unit is contained and wherein the hull has an access opening through the hull for accessing the water inlet portion when rotated.

22. A jet propelled watercraft according to claim 21 further including seal means interposed between the water inlet portion and the hull when the jet propulsion unit is in its normal operating position.

23. A jet propelled watercraft according to claim 22 wherein the power means comprises a first and second motor operated in sequence.

24. A jet propelled watercraft according to claim 20 wherein the water inlet portion of the jet propulsion unit is rotated relative to another portion thereof.

25. A jet propelled watercraft according to claim 24 wherein the power means comprises a first and second motor operated in sequence.

26. A jet propelled watercraft according to claim 20 wherein the entire jet propulsion unit is supported for rotation.

27. A jet propelled watercraft according to claim 26 wherein the power means comprises a first and second motor operated in sequence.

28. A jet propulsion unit for a watercraft comprising a water inlet housing portion having an inlet opening for drawing water from a body of water in which the watercraft is operated, an impeller housing portion for containing an impeller for drawing water through said water inlet opening, and a discharge nozzle housing portion defining a water outlet for return of water back to the body of water for propelling the watercraft, means for journalling at least two of said housing portions for relative rotation, said two housing portions having telescoped cylindrical sections, means for defining a circumferential groove in one of said sections, a piston formed in the other of said sections extending into said groove to separate said groove into a pair of arcuate variable volume chambers, and means for selectively pressurizing said chambers for effecting relative rotation between said housing portions.

29. A jet propulsion unit according to claim 28 wherein the piston has a pair of oppositely directed passages containing pressure responsive check valves for functioning as a relief valve assembly.

* * * * *